US011600916B2

(12) United States Patent
Lyn et al.

(10) Patent No.: US 11,600,916 B2
(45) Date of Patent: Mar. 7, 2023

(54) AREA-EFFICIENT BALUN

(71) Applicant: QUALCOMM Incorporated, San Diego, CA (US)

(72) Inventors: Sean Joel Lyn, Cupertino, CA (US); Cheng-Han Wang, San Jose, CA (US); Hye Jin Song, Santa Clara, CA (US); Hai Huang, San Jose, CA (US); Sang-Oh Lee, Cupertino, CA (US)

(73) Assignee: QUALCOMM Incorporated, San Diego, CA (US)

( * ) Notice: Subject to any disclaimer, the term of this patent is extended or adjusted under 35 U.S.C. 154(b) by 40 days.

(21) Appl. No.: 17/164,494

(22) Filed: Feb. 1, 2021

(65) Prior Publication Data

US 2021/0257726 A1 Aug. 19, 2021

Related U.S. Application Data

(60) Provisional application No. 62/978,016, filed on Feb. 18, 2020.

(51) Int. Cl.

| | |
|---|---|
| ***H01Q 7/00*** | (2006.01) |
| ***H01P 5/10*** | (2006.01) |
| ***H01Q 1/50*** | (2006.01) |

(52) U.S. Cl.

CPC ..... *H01Q 1/50* (2013.01); *H01P 5/10* (2013.01)

(58) Field of Classification Search

CPC .... H01P 5/10; H01Q 1/50; H01Q 7/00; H01F 41/02; H01F 41/04; H03H 7/42

See application file for complete search history.

(56) References Cited

U.S. PATENT DOCUMENTS

| | | | | |
|---|---|---|---|---|
| 7,876,227 | B2 * | 1/2011 | Bellows | H01Q 21/24 340/539.11 |
| 8,427,388 | B2 * | 4/2013 | Fahs | H01P 5/10 343/859 |
| 8,552,812 | B2 * | 10/2013 | Yen | H01L 23/5223 336/200 |
| 2016/0027571 | A1 * | 1/2016 | Zhang | H01F 27/2804 336/173 |

FOREIGN PATENT DOCUMENTS

| | | | | |
|---|---|---|---|---|
| CN | 206040388 U | * | 3/2017 | H01F 27/2804 |
| CN | 209170317 U | * | 7/2019 | G01R 33/3614 |

* cited by examiner

*Primary Examiner* — Tho G Phan

(74) *Attorney, Agent, or Firm* — Patterson + Sheridan LLP

(57) ABSTRACT

An area-efficient balun and a method for signal processing using such a balun. One example balun generally includes a winding and a clamping circuit. The winding is formed by a coiled trace including a first portion having a first trace width and a second portion having a second trace width, the second trace width being narrower than the first trace width. The clamping circuit has a first terminal and a second terminal, the first terminal of the clamping circuit being coupled to the first portion of the coiled trace.

30 Claims, 7 Drawing Sheets

AREA-EFFICIENT BALUN

CROSS-REFERENCE TO RELATED APPLICATION

This application claims the benefit of priority to U.S. Provisional Application No. 62/978,016, filed on Feb. 18, 2020, which is expressly incorporated by reference in its entirety as if fully set forth below and for all applicable purposes.

FIELD

Certain aspects of the present disclosure generally relate to electronic circuits and, more particularly, to an area-efficient balun with desirable electrostatic discharge (ESD) protection.

BACKGROUND

A wireless communication network may include a number of base stations that can support communication for a number of mobile stations. A mobile station (MS) may communicate with a base station (BS) via a downlink and an uplink. The downlink (or forward link) refers to the communication link from the base station to the mobile station, and the uplink (or reverse link) refers to the communication link from the mobile station to the base station. A base station may transmit data and control information on the downlink to a mobile station and/or may receive data and control information on the uplink from the mobile station.

The base station and/or mobile station may include a transmitter, which may include an amplifier (e.g., a drive amplifier) and a balun. A balun, in general, joins a balanced line (with two conductors and equal currents in opposite directions) to an unbalanced line (with one conductor and a ground). The balun may be used, for example, to convert a differential signal to a single-ended signal, or vice versa.

SUMMARY

The systems, methods, and devices of the disclosure each have several aspects, no single one of which is solely responsible for its desirable attributes. Without limiting the scope of this disclosure as expressed by the claims that follow, some features will now be discussed briefly. After considering this discussion, and particularly after reading the section entitled "Detailed Description," one will understand how the features of this disclosure provide advantages that include a balun with desirable area efficiency, while still providing a large inductance, a relatively good quality factor (Q), and sufficient electrostatic discharge (ESD) protection.

Certain aspects of the present disclosure provide a balun, which generally includes a winding and a clamping circuit. The winding is formed by a coiled trace including a first portion having a first trace width and a second portion having a second trace width, the second trace width being narrower than the first trace width. The clamping circuit has a first terminal and a second terminal, the first terminal of the clamping circuit being coupled to the first portion of the coiled trace.

Certain aspects of the present disclosure are directed to an apparatus for wireless communications comprising a transceiver front-end, the transceiver front-end having a balun. The balun generally includes a winding and a clamping circuit. The winding is formed by a coiled trace including a first portion having a first trace width and a second portion having a second trace width, the second trace width being narrower than the first trace width. The clamping circuit has a first terminal and a second terminal, the first terminal of the clamping circuit being coupled to the first portion of the coiled trace.

Certain aspects of the present disclosure provide a method of signal processing. The method generally includes amplifying a differential signal and converting the amplified differential signal to a single-ended signal using a balun. The balun generally includes a winding formed by a coiled trace and a clamping circuit having a first terminal and a second terminal. The coiled trace includes a first portion having a first trace width and a second portion having a second trace width, the second trace width being narrower than the first trace width. The first terminal of the clamping circuit is coupled to the first portion of the coiled trace.

To the accomplishment of the foregoing and related ends, the one or more aspects comprise the features hereinafter fully described and particularly pointed out in the claims. The following description and the appended drawings set forth in detail certain illustrative features of the one or more aspects. These features are indicative, however, of but a few of the various ways in which the principles of various aspects may be employed.

BRIEF DESCRIPTION OF THE DRAWINGS

So that the manner in which the above-recited features of the present disclosure can be understood in detail, a more particular description, briefly summarized above, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects.

To facilitate understanding, identical reference numerals have been used, where possible, to designate identical elements that are common to the figures. It is contemplated that elements disclosed in one aspect may be beneficially utilized on other aspects without specific recitation.

DETAILED DESCRIPTION

Certain aspects of the present disclosure provide a balun. The balun may be an area-efficient balun, providing a relatively large inductance and high quality factor (Q) despite a relatively smaller area compared to other balun designs. Furthermore, the balun may include electrostatic discharge (ESD) circuitry with a length of a winding separating the ESD circuitry from the output node of the balun, to prevent, or at least reduce, linearity degradation of the balun.

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The word "exemplary" is used herein to mean "serving as an example, instance, or illustration." Any aspect described herein as "exemplary" is not necessarily to be construed as preferred or advantageous over other aspects.

As used herein, the term "connected with" in the various tenses of the verb "connect" may mean that element A is directly connected to element B or that other elements may be connected between elements A and B (i.e., that element A is indirectly connected with element B). In the case of electrical components, the term "connected with" may also be used herein to mean that a wire, trace, or other electrically conductive material is used to electrically connect elements A and B (and any components electrically connected therebetween).

An Example Wireless System

Figure 1:
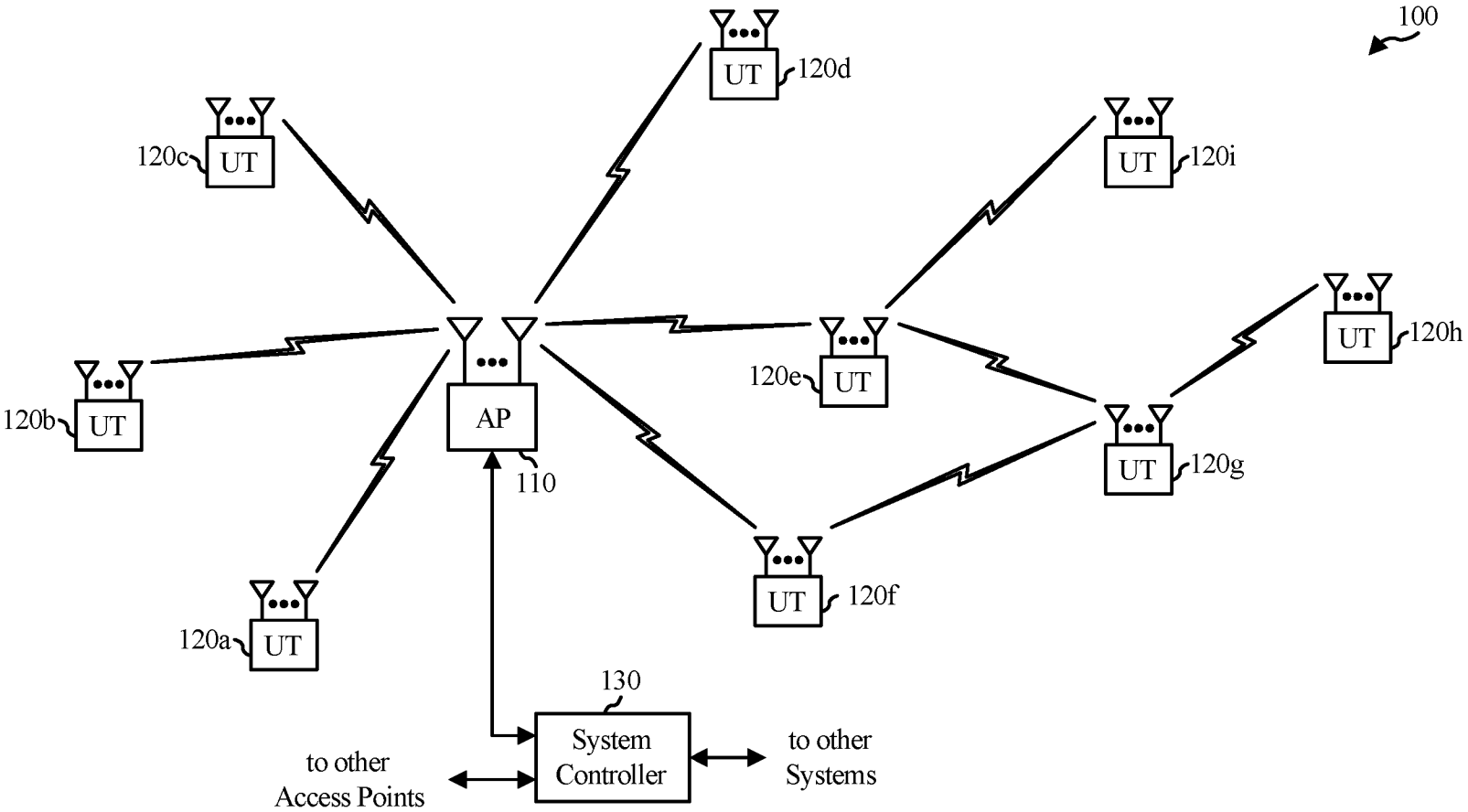
FIG. 1 is a diagram of an example wireless communications network, in accordance with certain aspects of the present disclosure.

FIG. 1 illustrates a wireless communications system 100 with access points 110 and user terminals 120, in which aspects of the present disclosure may be practiced. For simplicity, only one access point 110 is shown in FIG. 1. An access point (AP) is generally a fixed station that communicates with the user terminals and may also be referred to as a base station (BS), an evolved Node B (eNB), or some other terminology. A user terminal (UT) may be fixed or mobile and may also be referred to as a mobile station (MS), an access terminal, user equipment (UE), a station (STA), a client, a wireless device, or some other terminology. A user terminal may be a wireless device, such as a cellular phone, a personal digital assistant (PDA), a handheld device, a wireless modem, a laptop computer, a tablet, a personal computer, etc.

Access point 110 may communicate with one or more user terminals 120 at any given moment on the downlink and uplink. The downlink (i.e., forward link) is the communication link from the access point to the user terminals, and the uplink (i.e., reverse link) is the communication link from the user terminals to the access point. A user terminal may also communicate peer-to-peer with another user terminal. A system controller 130 couples to and provides coordination and control for the access points.

Wireless communications system 100 uses multiple transmit and multiple receive antennas for data transmission on the downlink and uplink. Access point 110 may be equipped with a number $N_{ap}$ of antennas to achieve transmit diversity for downlink transmissions and/or receive diversity for uplink transmissions. A set $N_u$ of selected user terminals 120 may receive downlink transmissions and transmit uplink transmissions. Each selected user terminal transmits user-specific data to and/or receives user-specific data from the access point. In general, each selected user terminal may be equipped with one or multiple antennas (i.e., $N_{ut} \geq 1$). The $N_u$ selected user terminals can have the same or different number of antennas.

Wireless communications system 100 may be a time division duplex (TDD) system or a frequency division duplex (FDD) system. For a TDD system, the downlink and uplink share the same frequency band. For an FDD system, the downlink and uplink use different frequency bands. Wireless communications system 100 may also utilize a single carrier or multiple carriers for transmission. Each user terminal 120 may be equipped with a single antenna (e.g., to keep costs down) or multiple antennas (e.g., where the additional cost can be supported).

In certain aspects of the present disclosure, the access point 110 and/or user terminal 120 may include at least one balun with a winding having portions with different trace widths and ESD protection circuitry, as described in more detail herein.

Figure 2:
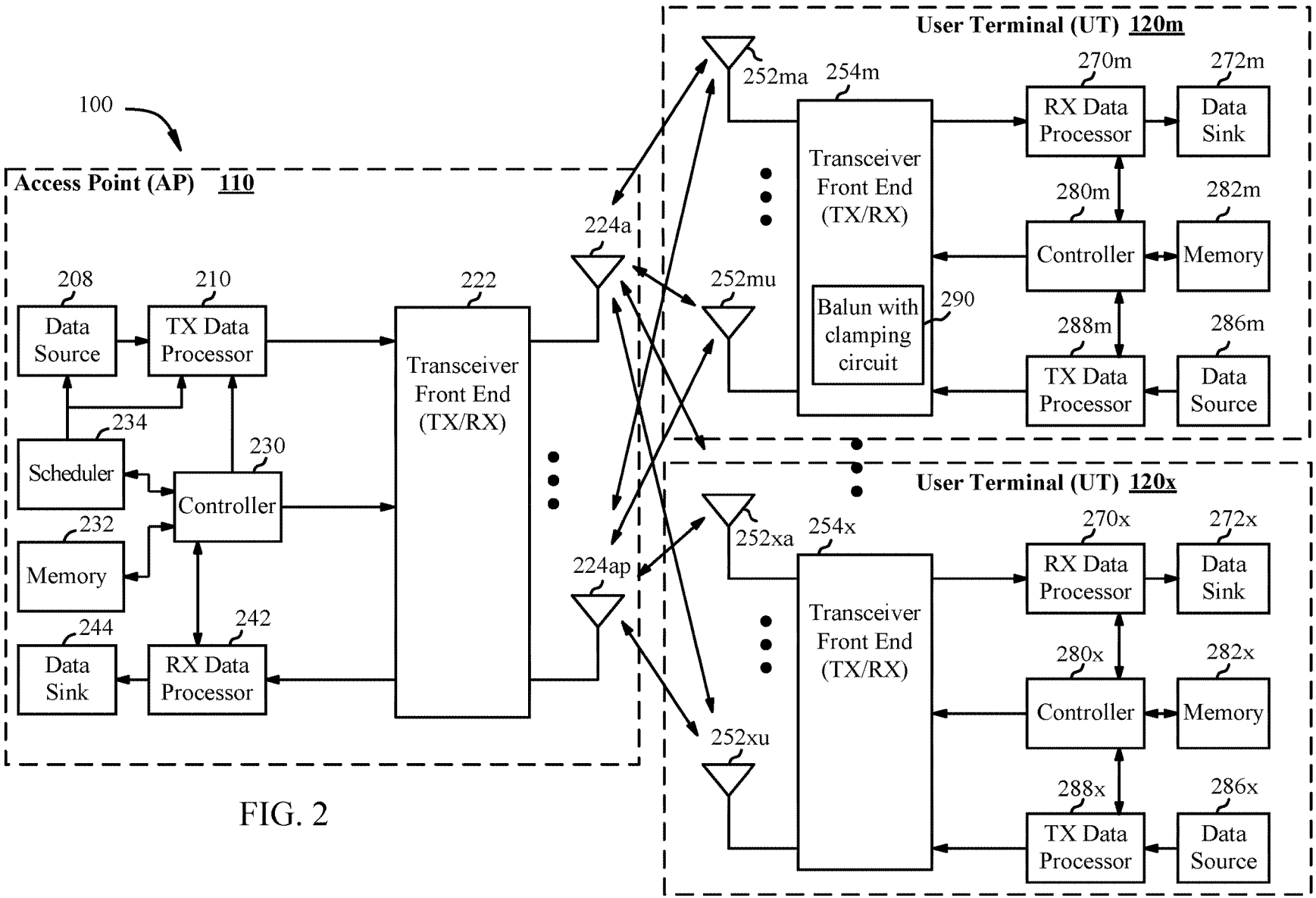
FIG. 2 is a block diagram of an example access point (AP) and example user terminals, in accordance with certain aspects of the present disclosure.

FIG. 2 shows a block diagram of access point 110 and two user terminals 120*m* and 120*x* in the wireless communications system 100. Access point 110 is equipped with $N_{ap}$ antennas 224*a* through 224*ap*. User terminal 120*m* is equipped with $N_{ut,m}$ antennas 252*ma* through 252*mu*, and user terminal 120*x* is equipped with $N_{ut,x}$ antennas 252*xa* through 252*xu*. Access point 110 is a transmitting entity for the downlink and a receiving entity for the uplink. Each user terminal 120 is a transmitting entity for the uplink and a receiving entity for the downlink. As used herein, a "transmitting entity" is an independently operated apparatus or device capable of transmitting data via a frequency channel, and a "receiving entity" is an independently operated apparatus or device capable of receiving data via a frequency channel. In the following description, the subscript "dn" denotes the downlink, the subscript "up" denotes the uplink, $N_{up}$ user terminals are selected for simultaneous transmission on the uplink, $N_{dn}$ user terminals are selected for simultaneous transmission on the downlink, $N_{up}$ may or may not be equal to $N_{dn}$, and $N_{up}$ and $N_{dn}$ may be static values or can change for each scheduling interval. Beam-steering or some other spatial processing technique may be used at the access point and user terminal.

On the uplink, at each user terminal 120 selected for uplink transmission, a TX data processor 288 receives traffic data from a data source 286 and control data from a controller 280. TX data processor 288 processes (e.g., encodes, interleaves, and modulates) the traffic data $\{d_{up}\}$ for the user terminal based on the coding and modulation schemes associated with the rate selected for the user terminal and provides a data symbol stream $\{s_{up}\}$ for one of the $N_{ut,m}$ antennas. A transceiver front-end (TX/RX) 254 (also known as a radio frequency front end (RFFE)) receives and processes (e.g., converts to analog, amplifies, filters, and frequency upconverts) a respective symbol stream to generate an uplink signal. The transceiver front-end 254 may also route the uplink signal to one of the $N_{ut,m}$ antennas for transmit diversity via an RF switch, for example. The controller 280 may control the routing within the transceiver front-end 254. Memory 282 may store data and program codes for the user terminal 120 and may interface with the controller 280.

A number $N_{up}$ of user terminals 120 may be scheduled for simultaneous transmission on the uplink. Each of these user terminals transmits its set of processed symbol streams on the uplink to the access point.

At access point 110, $N_{ap}$ antennas 224*a* through 224*ap* receive the uplink signals from all $N_{up}$ user terminals transmitting on the uplink. For receive diversity, a transceiver front-end 222 may select signals received from one of the antennas 224 for processing. The signals received from multiple antennas 224 may be combined for enhanced receive diversity. The access point's transceiver front end 222 also performs processing complementary to that performed by the user terminal's transceiver front end 254 and provides a recovered uplink data symbol stream. The recovered uplink data symbol stream is an estimate of a data symbol stream $\{s_{up}\}$ transmitted by a user terminal. An RX data processor 242 processes (e.g., demodulates, deinterleaves, and decodes) the recovered uplink data symbol stream in accordance with the rate used for that stream to obtain decoded data. The decoded data for each user terminal may be provided to a data sink 244 for storage and/or a controller 230 for further processing.

In certain aspects of the present disclosure, the transceiver front-end (TX/RX) 222 of access point 110 and/or transceiver front-end 254 of user terminal 120 may include a balun with a winding having portions with different trace widths and ESD protection circuitry, as described in more detail herein.

On the downlink, at access point 110, a TX data processor 210 receives traffic data from a data source 208 for $N_{dn}$ user terminals scheduled for downlink transmission, control data from a controller 230 and possibly other data from a scheduler 234. The various types of data may be sent on different transport channels. TX data processor 210 processes (e.g., encodes, interleaves, and modulates) the traffic data for each user terminal based on the rate selected for that user terminal. TX data processor 210 may provide a downlink data symbol streams for one of more of the $N_{dn}$ user terminals to be transmitted from one of the $N_{ap}$ antennas. The transceiver front-end 222 receives and processes (e.g., converts to analog, amplifies, filters, and frequency upconverts) the symbol stream to generate a downlink signal. The transceiver front-end 222 may also route the downlink signal to one or more of the $N_{ap}$ antennas 224 for transmit diversity via an RF switch, for example. The controller 230 may control the routing within the transceiver front-end 222. Memory 232 may store data and program codes for the access point 110 and may interface with the controller 230.

At each user terminal 120, $N_{ut,m}$ antennas 252 receive the downlink signals from access point 110. For receive diversity at the user terminal 120, the transceiver front-end 254 may select signals received from one of the antennas 252 for processing. The signals received from multiple antennas 252 may be combined for enhanced receive diversity. The user terminal's transceiver front end 254 also performs processing complementary to that performed by the access point's transceiver front end 222 and provides a recovered downlink data symbol stream. An RX data processor 270 processes (e.g., demodulates, deinterleaves, and decodes) the recovered downlink data symbol stream to obtain decoded data for the user terminal.

Figure 3:
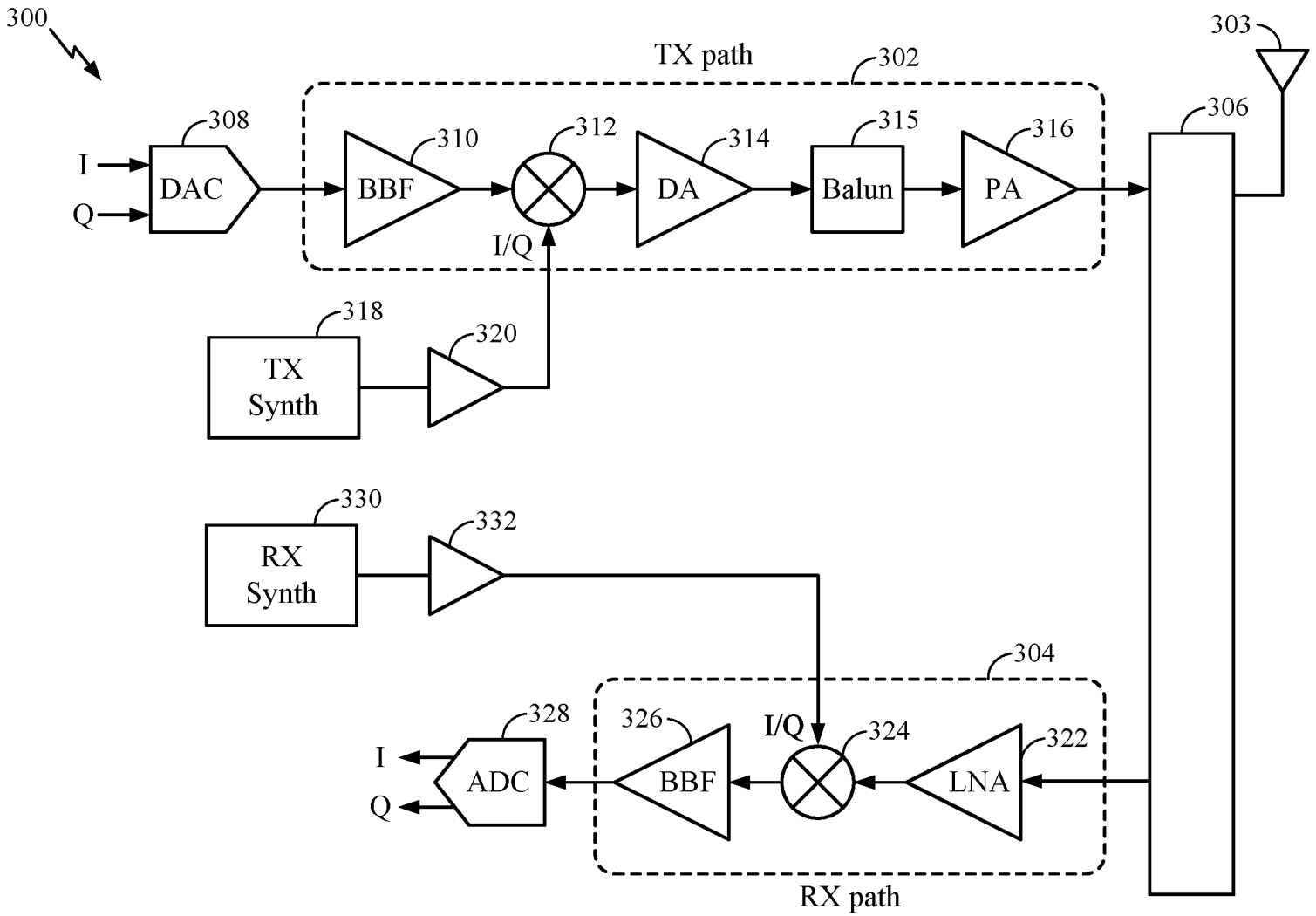
FIG. 3 is a block diagram of an example transceiver front-end, in accordance with certain aspects of the present disclosure.

FIG. 3 is a block diagram of an example transceiver front-end 300, such as transceiver front-ends 222, 254 in FIG. 2, in which aspects of the present disclosure may be practiced. The transceiver front-end 300 includes a transmit (TX) path 302 (also known as a "transmit chain") for transmitting signals via one or more antennas and a receive (RX) path 304 (also known as a "receive chain") for receiving signals via the antennas. When the TX path 302 and the RX path 304 share an antenna 303, the paths may be connected with the antenna via an interface 306, which may include any of various suitable RF devices, such as a duplexer, a switch, a diplexer, and the like.

Receiving in-phase (I) or quadrature (Q) baseband analog signals from a digital-to-analog converter (DAC) 308, the TX path 302 may include a baseband filter (BBF) 310, a mixer 312, a driver amplifier (DA) 314, and a power amplifier (PA) 316. The BBF 310, the mixer 312, and the DA 314 may be included in a radio frequency integrated circuit (RFIC), while the PA 316 may be external to the RFIC. The BBF 310 filters the baseband signals received from the DAC 308, and the mixer 312 mixes the filtered baseband signals with a transmit local oscillator (LO) signal to convert the baseband signal of interest to a different frequency (e.g., upconvert from baseband to RF). This frequency conversion process produces the sum and difference frequencies of the LO frequency and the frequency of the signal of interest. The sum and difference frequencies are referred to as the "beat frequencies." The beat frequencies are typically in the RF range, such that the signals output by the mixer 312 are typically RF signals, which may be amplified by the DA 314 and/or by the PA 316 before transmission by the antenna 303.

For certain aspects, there may be a balun 315 coupled between the DA 314 and the PA 316 for converting differential signals output by the DA 314 to single-ended signals input to the PA 316. The balun 315 may be implemented with a winding having portions with different trace widths and ESD protection circuitry, as described below.

The RX path 304 includes a low noise amplifier (LNA) 322, a mixer 324, and a baseband filter (BBF) 326. The LNA 322, the mixer 324, and the BBF 326 may be included in a radio frequency integrated circuit (RFIC), which may or may not be the same RFIC that includes the TX path components. RF signals received via the antenna 303 may be amplified by the LNA 322, and the mixer 324 mixes the amplified RF signals with a receive local oscillator (LO) signal to convert the RF signal of interest to a different baseband frequency (i.e., downconvert). The baseband signals output by the mixer 324 may be filtered by the BBF 326 before being converted by an analog-to-digital converter (ADC) 328 to digital I or Q signals for digital signal processing.

Some systems may employ frequency synthesizers with a voltage-controlled oscillator (VCO) to generate a stable, tunable LO with a particular tuning range. Thus, the transmit LO frequency may be produced by a TX frequency synthesizer 318, which may be buffered or amplified by amplifier 320 before being mixed with the baseband signals in the mixer 312. Similarly, the receive LO frequency may be produced by an RX frequency synthesizer 330, which may be buffered or amplified by amplifier 332 before being mixed with the RF signals in the mixer 324.

FIGS. 1-3 provide a wireless communication system as an example application in which certain aspects of the present disclosure may be implemented to facilitate understanding.

It is to be noted, however, that certain aspects provided herein can be employed in any of various other suitable systems.

An Example Balun

For many drive amplifier (DA) designs, high gain is desired. However, there are many design challenges and trade-offs to achieve a DA circuit with high gain. A designer may want to couple the DA to a balun with a large inductance (e.g., 4-5 nH) and a high quality factor (Q), but a balun that does not occupy a large area or suffer from nonlinearity effects due to electrostatic discharge (ESD) circuitry. For example, very large inductance can be obtained with the windings of certain off-chip baluns. In this case, an off-chip balun is a balun that does not share the same substrate as the drive amplifier (DA) and/or other components of a transmit chain or other circuitry connected to the balun. Such off-chip balun windings may have very good Q and a very large inductance, but may occupy a relatively large PCB area, be costly, and have excessive parasitics. A different example may be implemented by an on-chip balun having windings with relatively wide trace widths to meet ESD specifications (e.g., a human body model (HBM) of 1 kV and a charged device model (CDM) of 250 V). While such an on-chip balun may have a winding that may provide a relatively large inductance and good Q, this design may occupy a relatively large silicon area, which leads to a larger die size and potential yield loss. In another example, an on-chip balun may have a winding that may be designed with relatively narrow trace widths. While this design may provide a very large inductance and also occupy a smaller area compared to other designs (which means lower die cost and better yield), the Q is relatively low, and this design may not meet certain ESD specifications. Furthermore, if an ESD circuit (e.g., an ESD clamp) is connected to the output of the balun (e.g., at a terminal of the secondary winding), the nonlinearity of diode(s) in the ESD circuit may cause linearity degradation for the DA circuit.

To overcome these design challenges, certain aspects of the present disclosure provide a balun comprising a winding with portions having different trace widths. For example, the winding may include a first portion with a first trace width and a second portion with a second trace width narrower than the first trace width. Such a balun may be area efficient, but still provide a large inductance with good Q.

Figure 4:
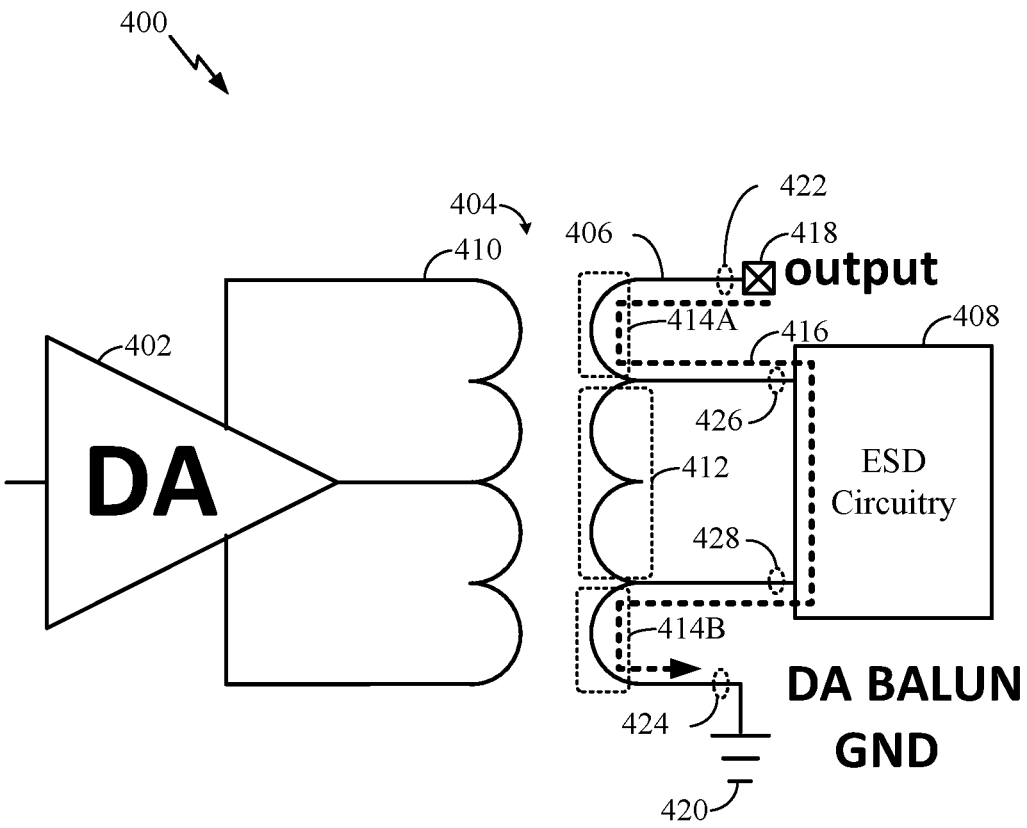
FIG. 4 is a block diagram of a driver amplifier (DA) and a balun having a secondary winding with different trace widths and an electrostatic discharge (ESD) circuit, in accordance with certain aspects of the present disclosure.

FIG. 4 is a block diagram 400 of a driver amplifier (DA) 402 and a balun 404 having a winding (e.g., a secondary winding 406) composed of portions with different trace widths and an ESD circuit 408 (also referred to herein as an "ESD clamp" or a "clamping circuit"), in accordance with certain aspects of the present disclosure. The DA 402 has a differential output coupled to a primary winding 410 of the balun 404, where the primary winding 410 is magnetically coupled to the secondary winding 406 in this transformer balun 404. The secondary winding 406 (with a relatively large inductance) has at least one relatively long, narrower routing section 412 (e.g., narrower to significantly reduce the area of the secondary winding) and one or more relatively short, wider routing sections 414A and 414B (collectively referred to herein as "wider routing sections 414") to improve the Q and/or to meet ESD specifications. For example, one of the wider routing section(s) 414 may be implemented as an outer coil of the secondary winding 406 in the physical layout, and the narrower routing section 412 may be implemented as an inner coil of the secondary winding 406.

As illustrated, the ESD circuit 408 may be coupled to the one or more wider routing sections 414, such that the ESD current 416 can flow through the ESD protection circuitry, instead of flowing directly through the narrower routing section 412. With the ESD circuit 408, the balun can provide ESD protection that meets certain ESD specifications (such as an HBM of 1 kV or greater and a CDM of 250 V or greater). Furthermore, by not connecting the ESD protection circuitry to an output node 418 directly, linearity may not be significantly affected. In FIG. 4, the ESD circuit 408 is illustrated with bi-directional discharge paths connected between the two wider routing sections 414 of the secondary winding 406. For other aspects, the discharge paths may be connected to a reference potential node 420 (e.g., electrical ground) for the circuit and/or to a terminal of the secondary winding 406.

For certain aspects, the one or more narrower routing sections 412 may have a constant trace width (e.g., about 2 μm). As used herein, a constant trace width generally refers to a width of a trace varying less than 5% from a nominal value. For certain aspects, one or more of the wider routing sections 414 may also have a constant trace width (e.g., about 6-12 μm). In aspects, the trace widths provided herein are merely examples and may vary depending on the desired electrical characteristics of the balun. In some cases, the different wider routing sections may have the same constant trace width. The width of the traces in the wider routing section(s) 414 may be at least three times the trace width of the traces in the narrower routing section(s) 412. For other aspects, the wider routing section(s) 414 may have a changing width (i.e., a non-uniform or variable width). For example, the wider routing section(s) 414 may have a tapered trace width, going from the widest trace width at one end to the trace width of the narrower routing section(s) 412 at the other end. This tapered trace width may be continuously tapered or graded (e.g., tapered in steps).

The length of the narrower routing section 412 may be greater than the combined length of the wider routing section(s) 414. For example, the length of the narrower routing section 412 may be at least 1.25 times the sum of the lengths of the wider routing section(s) 414.

In aspects, the secondary winding 406 may be formed by or implemented with a coiled trace. The coiled trace may include a first portion (e.g., the wider routing section 414A) having a first trace width and a second portion (e.g., the narrower routing section 412) having a second trace width. The second trace width may be narrower than the first trace width. The first trace width may be about three times larger than the second trace width. The first trace width may be a substantially constant width throughout the first portion of the coiled trace. In other cases, the first portion of the coiled trace may have a changing width, going from the first trace width to the second trace width.

The coiled trace may further comprise a third portion (e.g., the wider routing section 414B) having a third trace width. The third trace width may also be wider than the second trace width. That is, the second trace width may be narrower than the first trace width and the third trace width. In aspects, the third trace width may be substantially the same (or the same) as the first trace width. As used herein, having substantially the same trace width or having a substantially constant trace width generally refers to a trace width that differs by less than 10% along the length(s) thereof.

The first portion of the coiled trace may be connected in series with the second portion of the coiled trace, and the second portion of the coiled trace may be connected in series with the third portion of the coiled trace. A length of the second portion of the coiled trace may be at least 1.25 times a sum of a length of the first portion and a length of the third portion.

The secondary winding 406 may have a first terminal 422 and a second terminal 424. The first terminal 422 of the secondary winding 406 may be coupled to the output node 418 of the balun 404 and the first portion of the coiled trace. The third portion of the coiled trace may be connected to the second terminal 424 of the secondary winding 406, and the second terminal 424 of the secondary winding 406 may be coupled to the reference potential node 420.

The ESD circuit 408 (i.e., clamping circuit) may have a first terminal 426 and a second terminal 428. The first terminal 426 and/or second terminal 428 of the ESD circuit 408 may be coupled to the first portion (e.g., the wider routing section 414A) of the coiled trace. In certain aspects, the second terminal 428 of the ESD circuit 408 may be coupled to the third portion (e.g., the wider routing section 414B) of the coiled trace. In aspects, the first terminal 426 of the ESD circuit 408 may be further coupled to a first end of the second portion (e.g., the narrower routing section 412) of the coiled trace, and the second terminal 428 of the ESD circuit 408 may be coupled to a second end of the second portion of the coiled trace. The first terminal 426 of the ESD circuit 408 may be separated from the first terminal 422 of the secondary winding 406 by a length of the first portion of the coiled trace. In certain cases, the ESD circuit 408 may be disposed in an area surrounded by a coil (e.g., the narrower routing section 412) of the coiled trace.

Figure 5A:
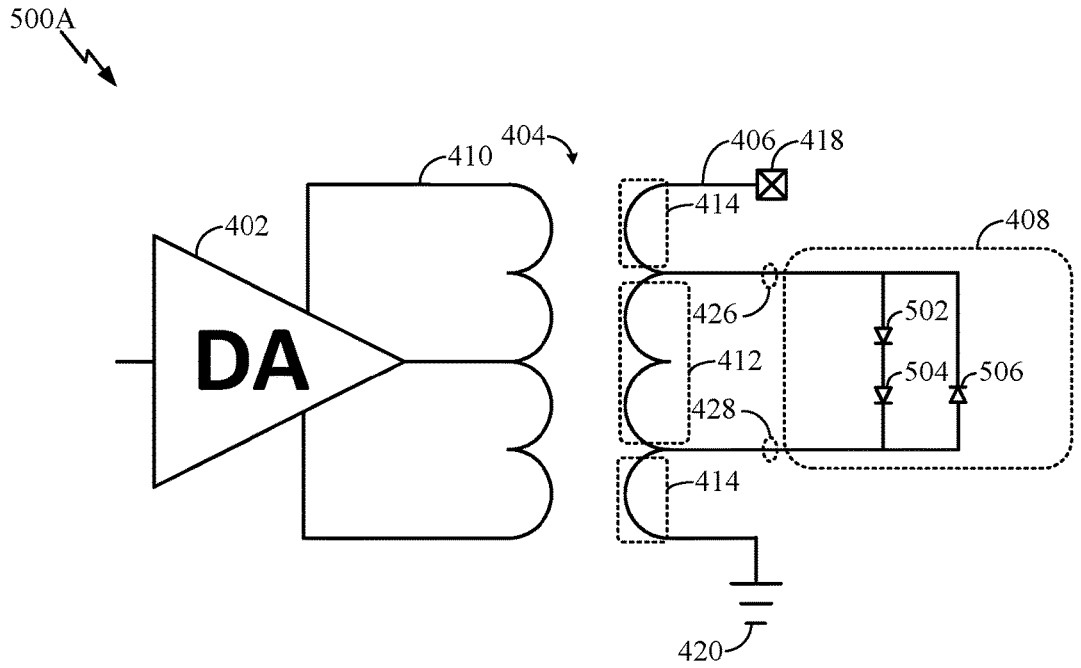
FIGS. 5A and 5B illustrate different implementations of the ESD circuit in FIG. 4, in accordance with certain aspects of the present disclosure.
Figure 5B:
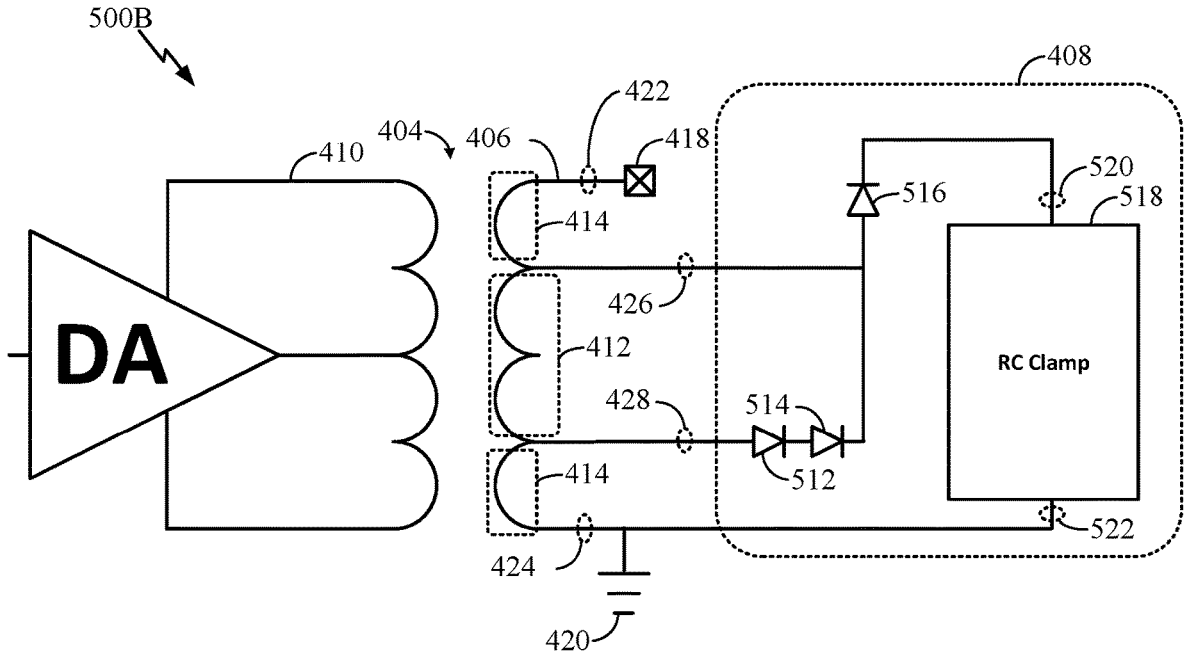

FIGS. 5A and 5B illustrate different implementations of the ESD circuit 408 in FIG. 4, in accordance with certain aspects of the present disclosure. For certain aspects, the ESD circuit 408 may be placed inside the output balun (e.g., disposed in an area surrounded by a coil of the secondary winding).

In certain aspects, the ESD circuit 408 may have a positive discharge path and a negative discharge path. As illustrated in FIG. 5A, each of the discharge paths includes one or more diodes 502, 504, 506. When multiple diodes (e.g., as shown) are used for a discharge path, the diodes may be connected in series in one direction (i.e., stacked diodes). For example, the diodes 502, 504 may be arranged in series and in a first direction between the terminals 426, 428. The series-connected diodes 502, 504 oriented in the first direction may constitute a positive discharge path. Furthermore, the diode 506 may be arranged in an opposite direction (and may thus constitute a negative discharge path) between the terminals 426, 428. In some cases, the number of diodes implemented in the ESD circuit 408 may depend on a desired output swing at the clamped nodes. In FIG. 5A, the positive discharge path includes two series-connected diodes 502, 504, whereas the negative discharge path includes only one diode 506. In aspects, the ESD circuit 408 may include a first set of one or more diodes (e.g., the diodes 502, 504) arranged in a first direction between the first terminal 426 and the second terminal 428 of the ESD circuit. The ESD circuit 408 may further include a second set of one or more diodes (e.g., the diode 506) arranged in a second direction between the first terminal 426 and the second terminal 428 of the ESD circuit 408, where the second direction (for a negative current discharge path) is opposite from the first direction (for a positive current discharge path).

In certain aspects, the ESD circuit may use a resistor-capacitor (RC) clamp in addition to stacked diodes to provide ESD protection. As shown in FIG. 5B, the negative discharge path may be implemented with a set of stacked diodes 512, 514 arranged in series, similar to that described above for FIG. 5A. However, the positive discharge path in FIG. 5B may use a diode 516 and a RC clamp 518. The RC clamp 518 may be connected to a terminal (e.g., the second terminal 424) of the secondary winding 406 of the balun 404, as illustrated. This terminal of the secondary winding may be a reference potential node 420 (e.g., electrical ground) for a circuit coupled to the secondary winding 406. In aspects, the ESD circuit 408 may include a first set of one or more diodes (e.g., the diode 516) coupled in series with a first terminal 520 of the RC clamp 518. At least one of the diodes (e.g., the diode 516) in the first set has an anode coupled to the first terminal 426 of the ESD circuit 408. The ESD circuit 408 may also include a second set of one or more diodes coupled between the first and second terminals of the ESD circuit 408 such that the anode of one of the diodes is coupled to the second terminal 428 of the ESD circuit 408. The RC clamp 518 may have a second terminal 522 coupled to the second terminal 424 of the secondary winding 406.

In the examples depicted in FIGS. 5A and 5B, the diodes may rectify the ESD signal and suppress the ESD signal from exceeding a certain clamping voltage associated with the diodes. In the example depicted in FIG. 5B, the RC clamp may provide a DC offset to the ESD signal with the capacitive element. The capacitor and resistor of the RC clamp may have a time constant that determines the frequency range over which the ESD circuit is effective.

Although only two configurations of the ESD circuit 408 with diodes (and an RC clamp) are depicted, the present disclosure is not so limited, and any of various other suitable ESD circuit configurations may be implemented. For example, the ESD circuit 408 can provide a discharging path from ground to the output pin during a negative ESD and/or a discharging path from ground to the output pin during a positive ESD. In certain cases, the ESD circuit can provide a discharging path from ground and a voltage rail (Vdd) to the output pin during the negative ESD and/or a discharging path from ground and the voltage rail to the output pin during a positive ESD.

Figure 6:
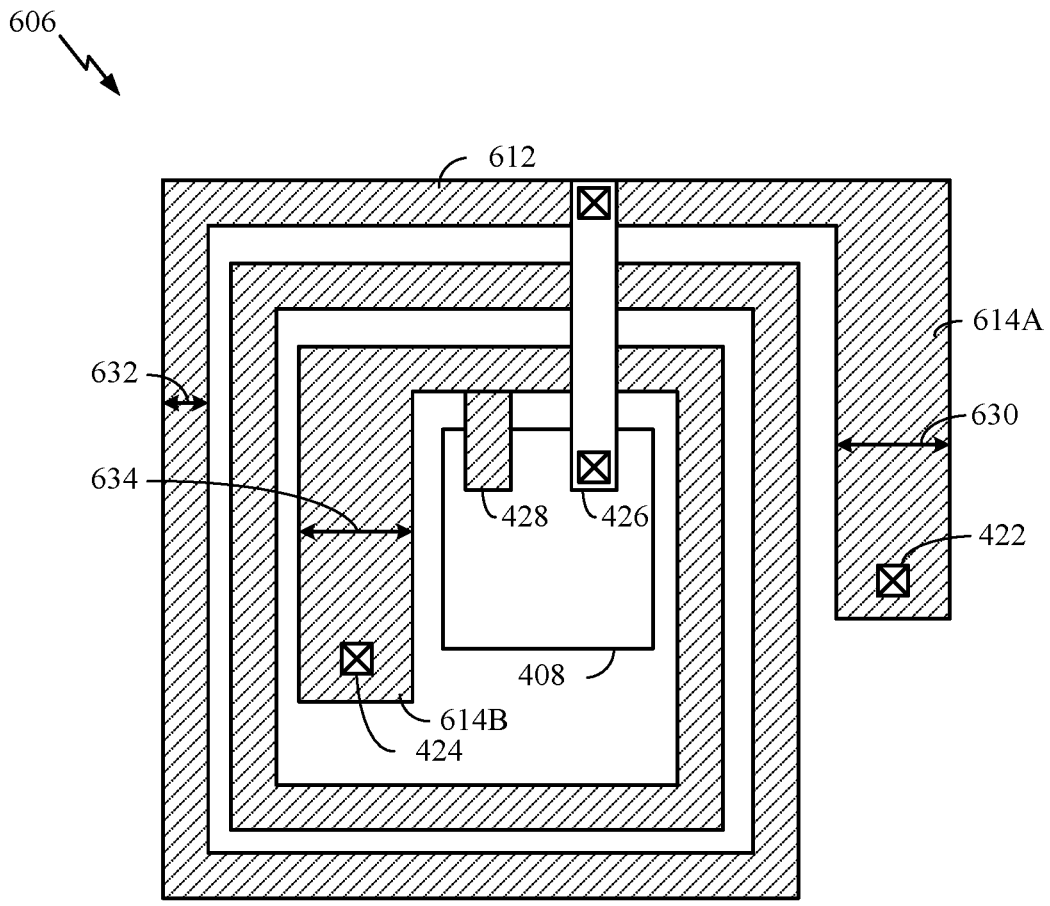
FIG. 6 illustrates a top view of an example layout of a winding with different trace widths and an ESD circuit, in accordance with certain aspects of the present disclosure.

FIG. 6 is a top view of an example layout of a winding 606 with different trace widths and the ESD circuit 408 coupled thereto, in accordance with certain aspects of the present disclosure. In this example, the winding 606 may be implemented as the secondary winding (e.g., the secondary winding 406) in a balun (e.g., the balun 404). The winding 606 may be formed by or implemented with a coiled trace, as shown. The coiled trace may include a first portion 614A having a first trace width 630 and a second portion 612 having a second trace width 632. The second trace width 632 may be narrower than the first trace width 630. For example, the first trace width 630 may be about three times larger than the second trace width 632. The first trace width 630 may be a substantially constant width throughout the first portion 614A of the coiled trace.

The coiled trace may further comprise a third portion 614B having a third trace width 634. The third trace width 634 may also be wider than the second trace width 632. That is, the second trace width 632 may be narrower than the first trace width 630 and the third trace width 634.

The ESD circuit 408 may be disposed in an area surrounded by a coil of the coiled trace. As shown, the ESD circuit 408 may be surrounded by at least the second portion 612 and the third portion 614B of the coiled trace. The first terminal 426 of the ESD circuit 408 may be coupled to the coiled trace through one or more vias (represented by the boxed X's) and a trace on a different routing layer than the coiled trace, as indicated by the unshaded trace in FIG. 6.

Example Signal Processing Operations

Figure 7:
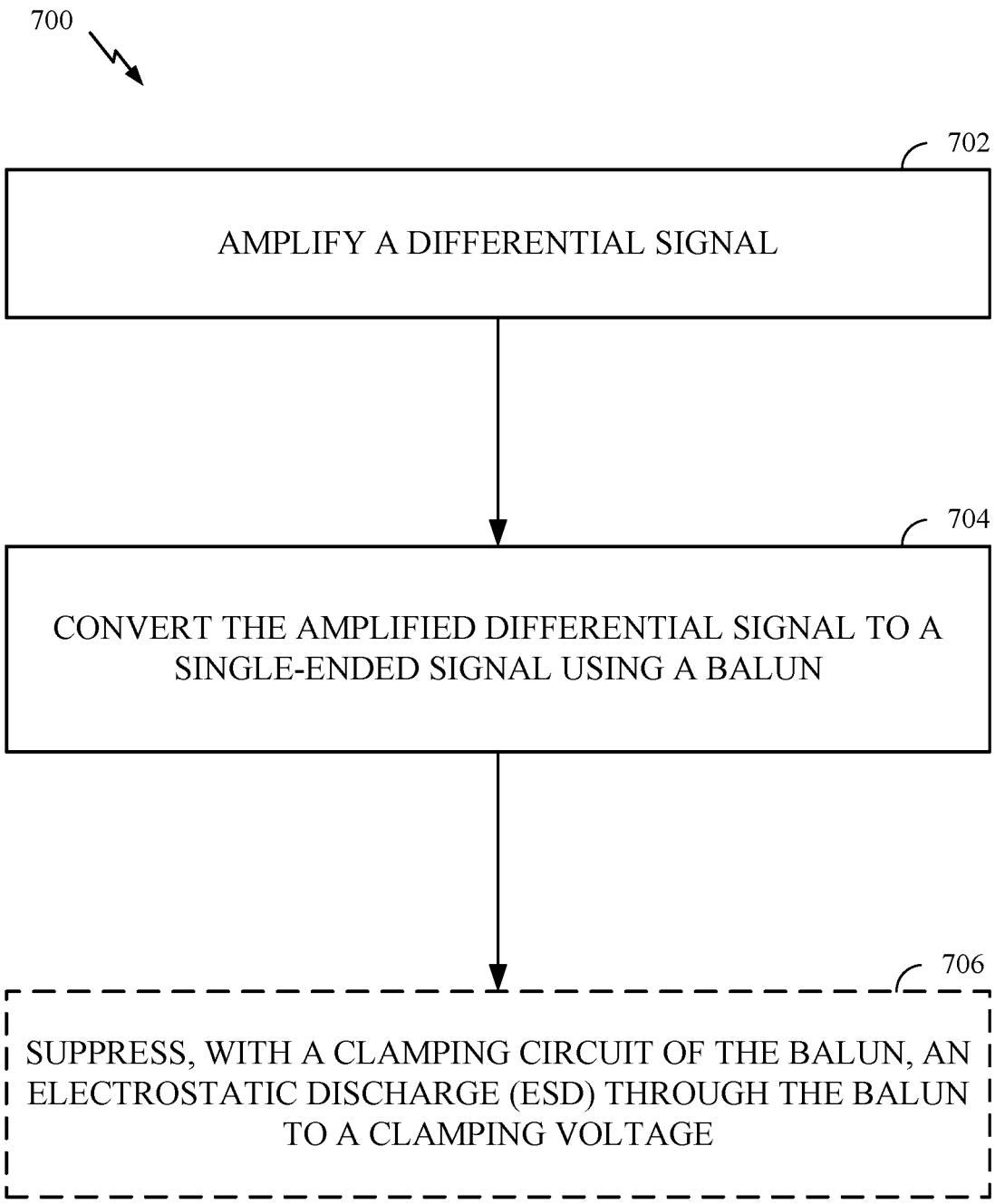
FIG. 7 is a flow diagram of example operations for processing a signal, in accordance with certain aspects of the present disclosure.

FIG. 7 is a flow diagram of example operations 700 for processing a signal, in accordance with certain aspects of the present disclosure. The operations 700 may be performed, for example, by a circuit comprising an amplifier (e.g., the DA 402) and a balun (e.g., the balun 404).

The operations 700 may begin, at block 702, with the amplifier amplifying a differential signal. At block 704, the circuit may convert the amplified differential signal to a single-ended signal using the balun. The balun generally includes a winding (e.g., secondary winding 406) formed by a coiled trace and a clamping circuit (e.g., ESD circuit 408) having a first terminal (e.g., first terminal 422) and a second terminal (e.g., second terminal 424). The coiled trace includes a first portion (e.g., section 414A or section 414B) having a first trace width and a second portion (e.g., section 412) having a second trace width, where the second trace width is narrower than the first trace width. The first terminal of the clamping circuit is coupled to the first portion of the coiled trace.

According to certain aspects, the operations 700 may further include the clamping circuit suppressing an electrostatic discharge (ESD) through the balun to a clamping voltage at optional block 706. For certain aspects, the clamping circuit is disposed in an area surrounded by a coil of the coiled trace. For certain aspects, the first terminal of the clamping circuit is further coupled to a first end of the second portion of the coiled trace and/or the second terminal of the clamping circuit is coupled to a second end of the second portion of the coiled trace. For certain aspects, the clamping circuit includes a first set of one or more diodes (e.g., diode 502, 504, 512, and/or 514) arranged in a first direction between the first terminal and the second terminal of the clamping circuit. In this case, suppressing the ESD at block 706 may involve suppressing the ESD with the first set of one or more diodes. For certain aspects, the clamping circuit further includes a second set of one or more diodes (e.g., diode 506) arranged in a second direction between the first terminal and the second terminal of the clamping circuit, the second direction being opposite from the first direction. In this case, suppressing the ESD at block 706 may involve suppressing the ESD with the second set of one or more diodes. For other aspects, the clamping circuit further comprises a second set of one or more diodes (e.g., diode 516) coupled in series with a first terminal (e.g., first terminal 520) of a resistor-capacitor clamp (e.g., the RC clamp 518), where at least one of the diodes in the second set has an anode coupled to the first terminal of the clamping circuit and where the resistor-capacitor clamp has a second terminal (e.g., second terminal 522) coupled to a terminal of the winding. In this case, suppressing the ESD at block 706 may involve suppressing the ESD with the second set of one or more diodes and the resistor-capacitor clamp.

According to certain aspects, the first trace width is at least three times larger than the second trace width.

According to certain aspects, the coiled trace further comprises a third portion (e.g., section 414B) having a third trace width. The third trace width may be wider than the second trace width.

Example Aspects

In addition to the various aspects described above, specific combinations of aspects are within the scope of the disclosure, some of which are detailed below:

Aspect 1: A balun comprising: a winding formed by a coiled trace, the coiled trace comprising: a first portion having a first trace width; and a second portion having a second trace width, the second trace width being narrower than the first trace width; and a clamping circuit having a first terminal and a second terminal, the first terminal of the clamping circuit being coupled to the first portion of the coiled trace.

Aspect 2: The balun of Aspect 1, wherein the coiled trace further comprises a third portion having a third trace width.

Aspect 3: The balun of Aspect 2, wherein the third trace width is wider than the second trace width.

Aspect 4: The balun of Aspect 2, wherein the third trace width is substantially the same as the first trace width.

Aspect 5: The balun according to any of Aspects 2-4, wherein the first portion is connected in series with the second portion of the coiled trace.

Aspect 6: The balun of Aspect 5, wherein the second portion is connected in series with the third portion of the coiled trace.

Aspect 7: The balun according to any of Aspects 2-6, wherein the first portion is connected to a first terminal of the winding.

Aspect 8: The balun of Aspect 7, wherein the third portion is connected to a second terminal of the winding.

Aspect 9: The balun according to any of Aspects 2-7, wherein a length of the second portion of the coiled trace is at least 1.25 times a sum of a length of the first portion and a length of the third portion.

Aspect 10: The balun according to any of Aspects 2-9, wherein the second terminal of the clamping circuit is coupled to the third portion of the coiled trace.

Aspect 11: The balun of Aspect 10, wherein: the first terminal of the clamping circuit is further coupled to a first end of the second portion of the coiled trace; and the second terminal of the clamping circuit is coupled to a second end of the second portion of the coiled trace.

Aspect 12: The balun according to any of Aspects 1-11, wherein: the winding comprises a first terminal and a second terminal; the first terminal of the winding is coupled to an output node of the balun; and the first terminal of the clamping circuit is separated from the first terminal of the winding by a length of the first portion of the coiled trace.

Aspect 13: The balun according to any of Aspects 1-12, wherein the clamping circuit comprises a first set of one or more diodes arranged in a first direction between the first terminal and the second terminal of the clamping circuit.

Aspect 14: The balun of Aspect 13, wherein the clamping circuit further comprises a second set of one or more diodes arranged in a second direction between the first terminal and the second terminal of the clamping circuit and wherein the second direction is opposite from the first direction.

Aspect 15: The balun of Aspect 13, wherein: the clamping circuit further comprises a second set of one or more diodes coupled in series with a first terminal of a resistor-capacitor clamp; at least one of the diodes in the second set has an anode coupled to the first terminal of the clamping circuit; and the resistor-capacitor clamp has a second terminal coupled to a terminal of the winding.

Aspect 16: The balun according to any of Aspects 1-15, wherein the clamping circuit is disposed in an area surrounded by a coil of the coiled trace.

Aspect 17: The balun according to any of Aspects 1-16, wherein the first trace width is about three times larger than the second trace width.

Aspect 18: The balun according to any of Aspects 1-17, wherein the first trace width is a substantially constant width throughout the first portion.

Aspect 19: The balun according to any of Aspects 1-17, wherein the first portion has a changing width, going from the first trace width to the second trace width.

Aspect 20: The balun according to any of Aspects 1-19, wherein the first portion of the coiled trace is connected in series with the second portion of the coiled trace.

Aspect 21: The balun according to any of Aspects 1-20, wherein the balun further comprises another winding magnetically coupled to the winding.

Aspect 22: A method of signal processing, comprising: amplifying a differential signal; and converting the amplified differential signal to a single-ended signal using a balun, the balun comprising: a winding formed by a coiled trace, the coiled trace comprising: a first portion having a first trace width; and a second portion having a second trace width, the second trace width being narrower than the first trace width; and a clamping circuit having a first terminal and a second terminal, the first terminal of the clamping circuit being coupled to the first portion of the coiled trace.

Aspect 23: The method of Aspect 22, further comprising suppressing, with the clamping circuit, an electrostatic discharge (ESD) through the balun to a clamping voltage.

Aspect 24: The method of Aspect 23, wherein the first terminal of the clamping circuit is further coupled to a first end of the second portion of the coiled trace and wherein the second terminal of the clamping circuit is coupled to a second end of the second portion of the coiled trace.

Aspect 25: The method of Aspect 23, wherein the clamping circuit comprises a first set of one or more diodes arranged in a first direction between the first terminal and the second terminal of the clamping circuit and wherein suppressing the ESD comprises suppressing the ESD with the first set of one or more diodes.

Aspect 26: The method of Aspect 25, wherein the clamping circuit further comprises a second set of one or more diodes arranged in a second direction between the first terminal and the second terminal of the clamping circuit, the second direction being opposite from the first direction, and wherein suppressing the ESD comprises suppressing the ESD with the second set of one or more diodes.

Aspect 27: The method of Aspect 25, wherein the clamping circuit further comprises a second set of one or more diodes coupled in series with a first terminal of a resistor-capacitor clamp, at least one of the diodes in the second set having an anode coupled to the first terminal of the clamping circuit, and the resistor-capacitor clamp having a second terminal coupled to a terminal of the winding and wherein suppressing the ESD comprises suppressing the ESD with the second set of one or more diodes and the resistor-capacitor clamp.

Aspect 28: The method according to any of Aspects 22-27, wherein the clamping circuit is disposed in an area surrounded by a coil of the coiled trace.

Aspect 29: The method according to any of Aspects 22-28, wherein the first trace width is at least three times larger than the second trace width.

Aspect 30: The method according to any of Aspects 22-29, wherein the coiled trace further comprises a third portion having a third trace width, the third trace width being wider than the second trace width.

Aspect 31: An apparatus for wireless communications comprising a transceiver front-end, the transceiver front-end having a balun comprising: a winding formed by a coiled trace, the coiled trace comprising: a first portion having a first trace width; and a second portion having a second trace width, the second trace width being narrower than the first trace width; and a clamping circuit having a first terminal and a second terminal, the first terminal of the clamping circuit being coupled to the first portion of the coiled trace.

Aspect 32: The apparatus of Aspect 31, further comprising an amplifier having a differential output, wherein the winding of the balun is a secondary winding, wherein the balun further comprises a primary winding magnetically coupled to the secondary winding, and wherein the differential output of the amplifier is coupled to the primary winding of the balun.

Aspect 33: The apparatus of Aspect 31 or 32, wherein the coiled trace further comprises a third portion having a third trace width, the third trace width being wider than the second trace width.

The various operations of methods described above may be performed by any suitable means capable of performing the corresponding functions. The means may include various hardware and/or software component(s) and/or module(s), including, but not limited to a circuit, an application-specific integrated circuit (ASIC), or processor. Generally, where there are operations illustrated in figures, those operations may have corresponding counterpart means-plus-function components with similar numbering.

As used herein, the term "determining" encompasses a wide variety of actions. For example, "determining" may include calculating, computing, processing, deriving, investigating, looking up (e.g., looking up in a table, a database, or another data structure), ascertaining, and the like. Also, "determining" may include receiving (e.g., receiving information), accessing (e.g., accessing data in a memory), and the like. Also, "determining" may include resolving, selecting, choosing, establishing, and the like.

As used herein, a phrase referring to "at least one of" a list of items refers to any combination of those items, including single members. As an example, "at least one of: a, b, or c" is intended to cover: a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

It is to be understood that the claims are not limited to the precise configuration and components illustrated above. Various modifications, changes, and variations may be made in the arrangement, operation, and details of the methods and apparatus described above without departing from the scope of the claims.

What is claimed is:

1. A balun comprising:

a winding formed by a coiled trace, the coiled trace comprising:

a first portion having a first trace width; and a second portion having a second trace width, the second trace width being narrower than the first trace width; and a clamping circuit having a first terminal and a second terminal, the first terminal of the clamping circuit being coupled to the first portion of the coiled trace.

2. The balun of claim 1, wherein the coiled trace further comprises a third portion having a third trace width.

3. The balun of claim 2, wherein the third trace width is wider than the second trace width.

4. The balun of claim 2, wherein the third trace width is substantially the same as the first trace width.

5. The balun of claim 2, wherein the first portion is connected in series with the second portion of the coiled trace.

6. The balun of claim 5, wherein the second portion is connected in series with the third portion of the coiled trace.

7. The balun of claim 2, wherein the first portion is connected to a first terminal of the winding.

8. The balun of claim 7, wherein the third portion is connected to a second terminal of the winding.

9. The balun of claim 2, wherein a length of the second portion of the coiled trace is at least 1.25 times a sum of a length of the first portion and a length of the third portion.

10. The balun of claim 2, wherein the second terminal of the clamping circuit is coupled to the third portion of the coiled trace.

11. The balun of claim 10, wherein:

the first terminal of the clamping circuit is further coupled to a first end of the second portion of the coiled trace; and the second terminal of the clamping circuit is coupled to a second end of the second portion of the coiled trace.

12. The balun of claim 1, wherein:

the winding comprises a first terminal and a second terminal;

the first terminal of the winding is coupled to an output node of the balun; and the first terminal of the clamping circuit is separated from the first terminal of the winding by a length of the first portion of the coiled trace.

13. The balun of claim 1, wherein the clamping circuit comprises a first set of one or more diodes arranged in a first direction between the first terminal and the second terminal of the clamping circuit.

14. The balun of claim 13, wherein the clamping circuit further comprises a second set of one or more diodes arranged in a second direction between the first terminal and the second terminal of the clamping circuit and wherein the second direction is opposite from the first direction.

15. The balun of claim 13, wherein:

the clamping circuit further comprises a second set of one or more diodes coupled in series with a first terminal of a resistor-capacitor clamp;

at least one of the diodes in the second set has an anode coupled to the first terminal of the clamping circuit; and the resistor-capacitor clamp has a second terminal coupled to a terminal of the winding.

16. The balun of claim 1, wherein the clamping circuit is disposed in an area surrounded by a coil of the coiled trace.

17. The balun of claim 1, wherein the first trace width is about three times larger than the second trace width.

18. The balun of claim 1, wherein the first trace width is a substantially constant width throughout the first portion.

19. The balun of claim 1, wherein the first portion has a changing width, going from the first trace width to the second trace width.

20. The balun of claim 1, wherein the first portion of the coiled trace is connected in series with the second portion of the coiled trace.

21. The balun of claim 1, wherein the balun further comprises another winding magnetically coupled to the winding.

22. An apparatus for wireless communications comprising a transceiver front-end, the transceiver front-end having a balun comprising:

a winding formed by a coiled trace, the coiled trace comprising:

a first portion having a first trace width; and a second portion having a second trace width, the second trace width being narrower than the first trace width; and a clamping circuit having a first terminal and a second terminal, the first terminal of the clamping circuit being coupled to the first portion of the coiled trace.

23. The apparatus of claim 22, further comprising an amplifier having a differential output, wherein the winding of the balun is a secondary winding, wherein the balun further comprises a primary winding magnetically coupled to the secondary winding, and wherein the differential output of the amplifier is coupled to the primary winding of the balun.

24. The apparatus of claim 22, wherein the coiled trace further comprises a third portion having a third trace width, the third trace width being wider than the second trace width.

25. A method of signal processing, comprising:

amplifying a differential signal; and converting the amplified differential signal to a single-ended signal using a balun, the balun comprising:

a winding formed by a coiled trace, the coiled trace comprising:

a first portion having a first trace width; and a second portion having a second trace width, the second trace width being narrower than the first trace width; and a clamping circuit having a first terminal and a second terminal, the first terminal of the clamping circuit being coupled to the first portion of the coiled trace.

26. The method of claim 25, further comprising suppressing, with the clamping circuit, an electrostatic discharge (ESD) through the balun to a clamping voltage.

27. The method of claim 26, wherein the first terminal of the clamping circuit is further coupled to a first end of the second portion of the coiled trace and wherein the second terminal of the clamping circuit is coupled to a second end of the second portion of the coiled trace.

28. The method of claim 26, wherein the clamping circuit comprises a first set of one or more diodes arranged in a first direction between the first terminal and the second terminal of the clamping circuit, and wherein suppressing the ESD comprises suppressing the ESD with the first set of one or more diodes.

29. The method of claim 28, wherein the clamping circuit further comprises a second set of one or more diodes arranged in a second direction between the first terminal and the second terminal of the clamping circuit, the second direction being opposite from the first direction, and wherein suppressing the ESD comprises suppressing the ESD with the second set of one or more diodes.

30. The method of claim 28, wherein the clamping circuit further comprises a second set of one or more diodes coupled in series with a first terminal of a resistor-capacitor clamp, at least one of the diodes in the second set having an anode coupled to the first terminal of the clamping circuit, and the resistor-capacitor clamp having a second terminal coupled to a terminal of the winding, and wherein suppressing the ESD comprises suppressing the ESD with the second set of one or more diodes and the resistor-capacitor clamp.

* * * * *